United States Patent [19]

Enzu

[11] Patent Number: 4,865,464

[45] Date of Patent: Sep. 12, 1989

[54] WATER TANK

[75] Inventor: Masao Enzu, Shizuoka, Japan

[73] Assignee: Senpaku Koheki Kabushiki Kaisha, Shizuoka, Japan

[21] Appl. No.: 188,161

[22] Filed: Apr. 15, 1988

Related U.S. Application Data

[63] Continuation of Ser. No. 911,352, Sep. 24, 1986, abandoned.

[51] Int. Cl.[4] ..... B65D 33/16

[52] U.S. Cl. ..... 383/44; 383/45

[58] Field of Search ..... 383/44, 45, 57

[56] References Cited

U.S. PATENT DOCUMENTS

| | | | |
|---|---|---|---|
| 2,799,314 | 7/1957 | Dreyer et al. | 383/44 |
| 3,297,152 | 1/1967 | Corella et al. | 383/44 |
| 3,367,485 | 2/1968 | Schneider et al. | 383/44 |
| 3,785,111 | 1/1974 | Pike | 383/44 |

FOREIGN PATENT DOCUMENTS

| | | | |
|---|---|---|---|
| 932448 | 7/1963 | United Kingdom | 383/44 |

*Primary Examiner*—Stephen P. Garbe

*Attorney, Agent, or Firm*—Lowe, Price, LeBlanc, Becker & Shur

[57] ABSTRACT

A water container comprises a bag body formed of a flexible material and a stopper means formed of a synthetic thin resin film. The stopper means is in the tubular form provided with a water inlet opening and a valve opening as well as a belt-like sealing on a portion except for the openings, and is attached into the bag body in such a manner that the inlet opening is open on the bag body and other portion is located within the bag body.

The valve opening is smaller in size than the inlet opening, and is positioned on a line extending from at least a portion of the sealing.

1 Claim, 3 Drawing Sheets

WATER TANK

This application is a continuation of application Ser. No. 911,352, filed Sept. 24, 1986 now abandoned.

BACKGROUND OF THE INVENTION

1. Field of the Invention

The present invention relates to a water container for drinkable water, etc., and more particularly to improvements in or relating to the structure of water containers which are formed of a flexible material adapted to decrease the size thereof.

2. Statement of the Prior Art

One of the known water containers formed of a flexible material is illustrated in FIGS. 6 and 7, for instance.

The illustrated tank comprises a bag body 1 formed of a synthetic resin or the like, which is provided with a stopper 2. The stopper 2 is formed of a thin synthetic resin film (e.g., of a polyethylene film), and is of tubular form that includes a water inlet opening 21 and a valve opening 22, and is provided with a sealing 23 at a portion except for said openings. It is appreciated that the sealing 23 may be provided by superposing a pair of wall portions forming the stopper 2 one upon another and fusing it together with the application of heat and pressure, or alternatively superposing wall portions of the stopper 2 one upon another and bonding it together with the use of adhesives. The stopper 2 is attached to the container in such a manner that the water inlet 21 is open on the bag body, and other portion is located within the bag body. It is noted that one (as illustrated) or plural inlet openings may be provided.

Such a container can widely be used for the emergency, outing or like purpose since, when not in use, it can be folded up into a smaller size for storage. In use, the container may be supplied with a given amount of water through the stopper 2. That is to say, for instance, a water tap may be inserted into the inlet 21 in the stopper 2 to pour water. The thus poured water then reaches the valve opening 22, while expanding out the portion thereof except for the sealing 23 under the pressure of the water, and flows therefrom into the bag body 1 (indicated by an arrow in FIG. 6). As the bag body is filled with a given amount of water, the tubular stopper 2 is flattened together under the pressure of the water to prevent backflow of the water. The aforesaid sealing 23 is provided to facilitate flattening of the stopper. To remove the water, a user's finger or a pipe may be fitted into the stopper 2 to push it open. Or, when the container is of the throwaway type, the bag body may be cut open to this end.

However, the prior art water container offers problems in connection with air tending to enter with the poured water during pouring. Another problem arises in connection with water leakage, since the aforesaid flattening has only an insufficient effect on the prevention of backflow of water.

SUMMARY OF THE INVENTION

The present invention is achieved to solve the problems as mentioned above, and has for its object to prevent entering of air into the water to be poured into a container and leakage of the water contained in the container.

According to the present invention, the objects of the present invention are achieved by the provision of a water container comprising a bag body formed of a flexible material and a stopper means formed of a synthetic resin film, said stopper means being in the tubular form provided with a water inlet opening and a valve opening as well as a sealing on a portion except for said openings, and being attached into said bag body in such a manner that said inlet opening is open on said bag body and other portion is located within said bag body, wherein:

said valve opening is smaller in size than said inlet opening, and is positioned on a line extending from at least a portion of said sealing.

BRIEF DESCRIPTION OF THE DRAWINGS

The aforesaid and other objects and features of the present invention will become apparent from the following detailed description with reference to the accompanying drawings, which are given for the purpose of illustration alone, and in which.

DETAILED DESCRIPTION OF THE PREFERRED EMBODIMENTS

Figure 1:
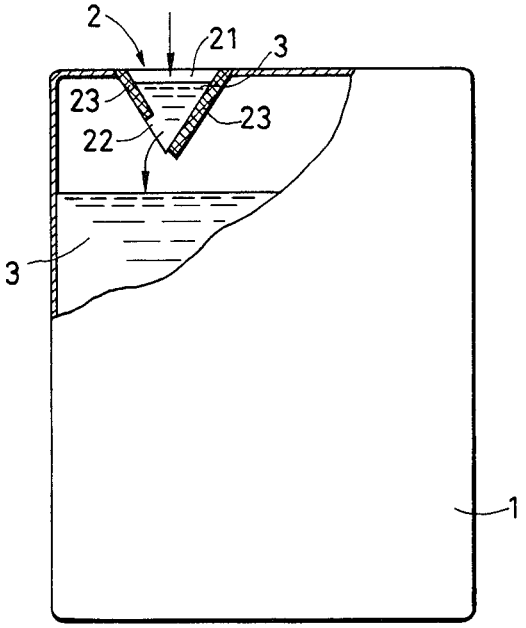
FIG. 1 is a sectional view illustrating one embodiment of the water tank according to the present invention.
Figure 2:
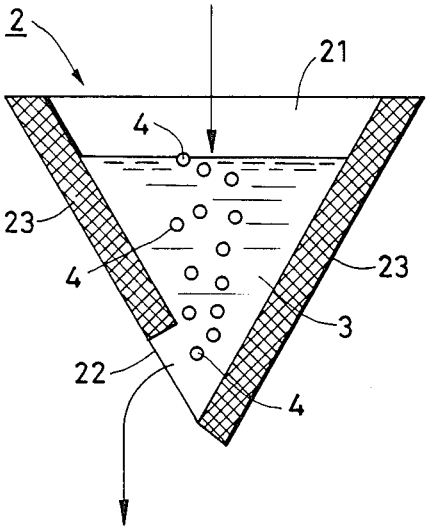
FIG. 2 is an enlarged view of part of the embodiment of FIG. 1.
Figure 3:
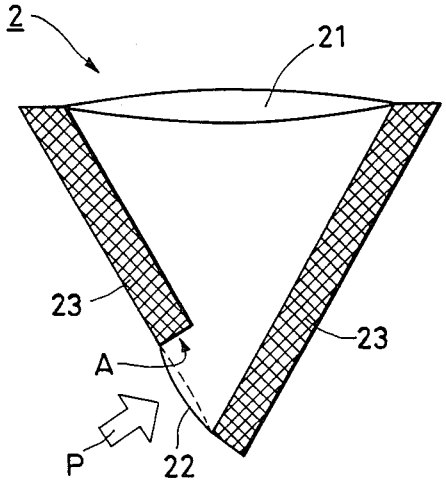
FIG. 3 is an enlarged perspective view of part of the embodiment of FIG. 1, FIGS. 4 and 5 are perspective views showing part of another embodiment of the present invention respectively.

Referring now to FIGS. 1 to 3, there is shown the first embodiment of the water container according to the present invention, wherein a stopper 2 is in the form of a funnel provided with a water inlet 21 and a valve opening 22. The valve opening 22 is smaller in size than water inlet 21, and is positioned on a line extending from one seal 23.

According to the first embodiment of the present invention, the water poured through the inlet 21 cannot immediately be fed into the valve opening 22 in the same amount as the amount poured, since that opening is smaller in size than the inlet 21. As illustrated in FIG. 2, the poured water is temporarily stored within the stopper 2, during which an amount of bubbles 4 contained therein ascends, and is then separated from the water. As bag body 1 is filled with a predetermined amount of water 3 in this manner, the stopper 2 is flattened together under the pressure of the water, as mentioned above. However, since the valve opening 22 is located on a line extending collinear with 23. The seal 23 imparts a closing or flattening force to the valve opening 22 that acts along the plane of the valve opening which is co-planar with the valve opening edges such that the pressure of water in the filled container is effectively applied to a portion of the seal adjacent the valve opening proximate arrow A in FIG. 3 to enhance the flattening force closing the valve opening 22. In addition, the portion A acts as a resistance to the pressure P of the water which tends to force open the valve opening 22 and pushes out the water, (and is especially effective in the width of the sealing 23). For that reason, the water contained in the bag body 1 does not leak out.

Figure 4:
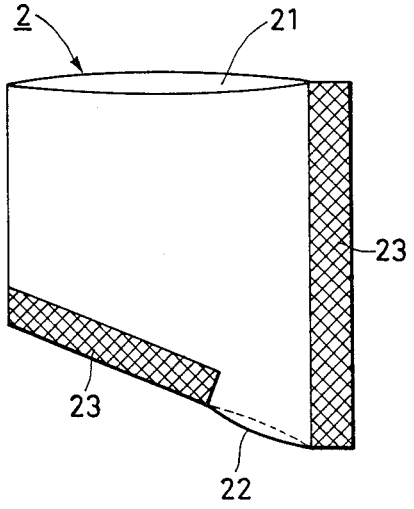
Figure 5:
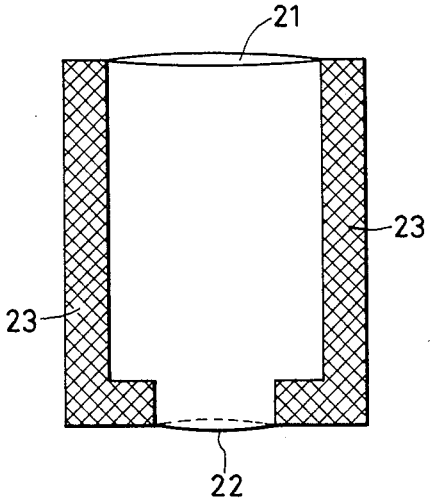
Figure 6:
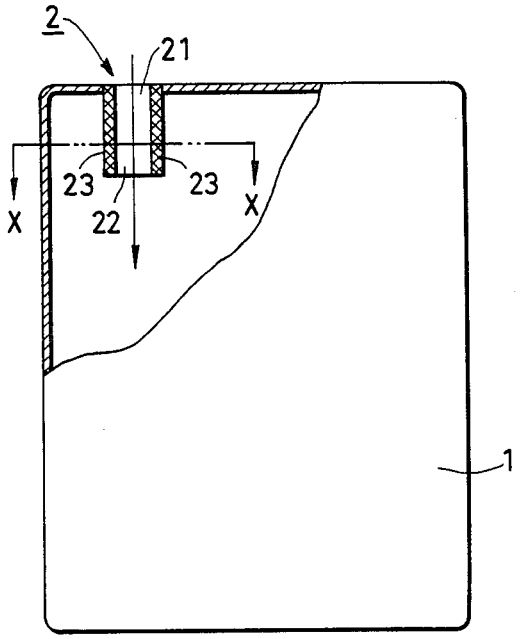
FIG. 6 PRIOR ART
FIG. 6 is a sectional view showing the prior art water tank.
Figure 7:
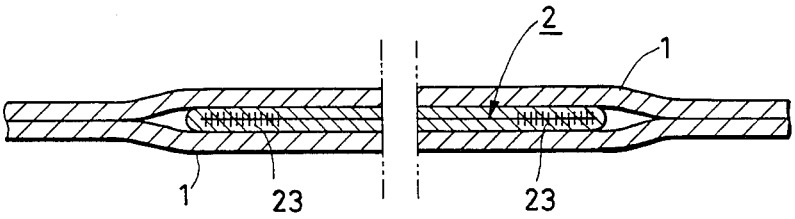
FIG. 7 PRIOR ART
FIG. 7 is a sectional view enlarged and taken along the line X—X of FIG. 6.

FIG. 4 illustrates a modification of the embodiment of FIGS. 1 and 2, wherein an inclined seal 23 is provided on one side, and a valve opening 22 is located on a line extending from the seal 23. FIG. 5 illustrates another modification wherein L-shaped sealings are provided in the opposite relation to each other, and a valve opening 22 is interposed therebetween. These modifications are used with the same effect and action as mentioned in connection with the first embodiment of FIGS. 1 to 3.

It is appreciated that, while the present invention has been described with reference to the two specific embodiments, the provision of a grip on the bag body 1 or an auxiliary stopper structure on the stopper 2 may be within the score of the present invention, as defined in the claim.

The water container according to the present invention serves to prevent entry of air into the water contained therein by making the valve opening smaller in size than the water inlet opening so as to temporarily store an amount of the water poured within the stopper for water.air separation. By the valve opening positioned on said extending line, it is possible to reinforce said flattening of the stopper and increase a resistance to the pressure of the water, which otherwise causes water leakage.

The foregoing water container according to the present invention finds use in applications where it is desired to preserve water over a prolonged period with no fear of any water decay, since no air enters the water during pouring. Owing to the fact that the water contained in the container according to the present invention does not possibly leak out, it can be used in any place, and is suitable to carry out. Further, the water container according to the present invention can be provided at a lower cost, since its stopper structure is slightly modified, compared with that of the prior art container.

What is claimed is:

1. A fluid container comprising a bag body formed of a first flexible material establishing a container interior and a valve means in said container interior formed of a second flexible material attached to the first flexible material, said valve means being defined by at least a pair of walls of said second flexible material, an inlet opening being defined between said pair of walls of the valve means in an upper portion of said valve means and a valve opening between said pair of walls and between a pair of sealed parts of said pair of walls of the valve means in a portion of the valve means located below the inlet opening and leading into the container interior, said valve opening being smaller in size than said inlet opening, and, in a closed position, said valve opening positioned on a line extending from and substantially entirely collinear with one of said sealed parts, said sealed parts being a pair of inclined seals, said pair of inclined seals of said pair of walls with second flexible material extending therebetween being generally triangular in plan view with the valve opening formed adjacent an apex collinear with said one of said seals, a lower end of said valve opening intersecting the other of said inclined seals.

* * * * *